US005982271A

United States Patent [19]

Handa

[11] Patent Number: 5,982,271

[45] Date of Patent: Nov. 9, 1999

[54] ORGANIC POSITIVE TEMPERATURE COEFFICIENT THERMISTOR

[75] Inventor: Tokuhiko Handa, Chiba, Japan

[73] Assignee: TDK Corporation, Tokyo, Japan

[21] Appl. No.: 08/979,665

[22] Filed: Nov. 26, 1997

[30] Foreign Application Priority Data

Nov. 28, 1996 [JP] Japan ..... 8-332979

[51] Int. Cl.[6] ..... H01C 7/10

[52] U.S. Cl. ..... 338/22 R; 252/512; 252/513; 338/25

[58] Field of Search ..... 338/25, 22 R, 338/225 D; 219/505; 252/519.33, 512, 513, 514

[56] References Cited

U.S. PATENT DOCUMENTS

| | | | |
|---|---|---|---|
| 3,243,753 | 3/1966 | Kohler . | |
| 3,351,882 | 11/1967 | Kohler et al. . | |
| 3,760,495 | 9/1973 | Meyer | 252/512 |
| 3,976,600 | 8/1976 | Meyer | 252/512 |
| 4,545,926 | 10/1985 | Fouts, Jr. et al. . | |
| 4,769,901 | 9/1988 | Nagahori | 338/22 R |
| 4,849,133 | 7/1989 | Yoshida et al. | 252/512 |
| 5,068,518 | 11/1991 | Yasuda | 219/549 |
| 5,294,374 | 3/1994 | Martinez et al. | 338/22 R |
| 5,378,407 | 1/1995 | Chandler et al. | 252/513 |
| 5,385,956 | 1/1995 | Schellekens et al. | 522/116 |
| 5,464,707 | 11/1995 | Moulton et al. | 429/212 |
| 5,554,679 | 9/1996 | Cheng | 524/495 |
| 5,672,637 | 9/1997 | Mahoney et al. | 252/512 |
| 5,742,223 | 4/1998 | Simendinger, III et al. | 338/22 R |

FOREIGN PATENT DOCUMENTS

| | | |
|---|---|---|
| 62-122083 | 6/1987 | Japan . |
| 62-156159 | 7/1987 | Japan . |
| 2-72580 | 3/1990 | Japan . |
| 2-172179 | 7/1990 | Japan . |
| 3-42681 | 6/1991 | Japan . |
| 3-187201 | 8/1991 | Japan . |
| 4-14201 | 1/1992 | Japan . |
| 4-28743 | 5/1992 | Japan . |
| 5-47503 | 2/1993 | Japan . |

*Primary Examiner*—Lincoln Donovan
*Assistant Examiner*—Karl Easthom
*Attorney, Agent, or Firm*—Oblon, Spivak, McClelland, Maier & Neustadt, P.C.

[57] ABSTRACT

An organic positive temperature coefficient thermistor contains polyethylene oxide where Mw>2,000,000 and conductive particles each having spiky protuberances. Preferably, the thermistor is prepared by blending the polyethylene oxide with the conductive particles interconnected in a chain form. The thermistor is operated at a temperature of 60 to 70° C. little harmful to the human body, and has low initial resistance in its non-operating state (at room temperature), a large rate of resistance change upon transition from its non-operating state to operating state, a sharp resistance rise upon operation, and stable performance even upon repetitive operation.

16 Claims, 11 Drawing Sheets

ORGANIC POSITIVE TEMPERATURE COEFFICIENT THERMISTOR

BACKGROUND OF THE INVENTION

1. Field of the Invention

The present invention relates generally to an organic positive temperature coefficient thermistor, and more particularly to an organic positive temperature coefficient thermistor that makes use of a phenomenon wherein its resistance value increases sharply with increase in a certain temperature, i.e., PTC (positive temperature coefficient of resistivity) characteristics.

2. Description of the Background

An organic positive temperature coefficient thermistor prepared by milling and dispersing conductive particles of carbon black, metal, etc. with and in a crystalline polymer and having PTC characteristics has been well known in the art, as typically disclosed in U.S. Pat. Nos. 3,243,753 and 3,351,882. This can be used as a self-regulating heater, a temperature sensor, and an overcurrent-protecting element. Requirements for this thermistor are its sufficiently low initial resistance value at room temperature (in its non-operating state), its large change in its resistance value at an operation temperature, and its stable performance upon repetitive operations.

For a prior art organic positive temperature coefficient thermistor, it is generally known that the crystalline polymer melts upon operation and, hence, the dispersion state of conductive particles changes upon cooling, resulting in increase in its initial resistance value.

For conventional organic positive temperature coefficient thermistors, carbon black is often used as conductive particles. A problem with carbon black is, however, that when a content of carbon black in an organic PTC thermistor is increased to lower the initial resistance value, no sufficient rate of resistance change is obtainable. Sometimes, particles of generally available metals are used as conductive particles. In this case, too, it is difficult to obtain both low initial resistance and a large rate of resistance change.

One approach to solve this problem is disclosed in JP-A 5-47503 that teaches the use of conductive particles having spiky protuberances. More specifically, it is disclosed that polyvinylidene fluoride is used as a crystalline polymer and spiky nickel powders are used as conductive particles having spiky protuberances, whereby a reasonable compromise can be reached between low initial resistance and a large resistance change. However, the thermistor set forth in this publication is less satisfactory in terms of performance stability upon repetitive operations. When the polyvinylidene fluoride is used, the operating temperature is about 160° C. However, if operating temperatures exceeding 100° C. are applied to such applications as protective elements for secondary batteries, electric blankets, toilet stool heaters, seats for vehicles, etc., they are extremely hazardous for the human body. To safeguard the human body, the operating temperature must be below 100° C., especially about 60 to 70° C.

U.S. Pat. No. 5,378,407, too, discloses a thermistor comprising filamentary nickel having spiky protuberances, and a polyolefin, olefinic copolymer or fluoropolymer, and alleges that this thermistor has low initial resistance, a large resistance change, and good-enough performance stability upon repeated operations. With highdensity polyethylene, and polyvinylidene fluoride polymers used in the examples, the operating temperatures are about 130° C. and about 160° C., respectively. Although this publication states that use may also be made of ethylene-ethyl acrylate copolymers, ethylene-vinyl acetate copolymers, ethylene-acrylic acid copolymers, etc., it fails to give examples using the copolymers. With these copolymers, the operating temperature of thermistors can be 60 to 70° C. As will be seen from examples to be given later, however, the performance of the thermistors upon repetitive operations is found to be unstable.

U.S. Pat. No. 4,545,926 discloses a similar thermistor comprising a spherical, flaky or rod form of nickel, and a polyolefin, olefinic copolymer, halogenated vinyl or vinylidene polymer. Some exemplified thermistors based on ethylene-ethyl acrylate copolymers, and ethylene-acrylic acid copolymers have an operating temperature of 60 to 70° C., and some exemplified thermistors based on other polymers have an operating temperature exceeding 100° C. However, the performance of thermistors based on ethylene-ethyl acrylate copolymers, and ethylene-acrylic acid copolymers are unstable upon repetitive operation, as already noted.

On the other hand, JP-A's 62-65401, 62-122083, 62-156159, 2-72580, 2-172179, 3-187201 and 4-14201 disclose thermistors comprising carbon or conductive metals, and polyethylene oxides. These thermistors may be operated at 60 to 70° C. However, it is impossible to obtain both low initial resistance and a large resistance change as already mentioned, because carbon, and conductive metals are used.

All these polyethylene oxides have molecular weights of 100,000 or lower. It has now been found that even when such polymers are used in combination with filamentary nickel having spiky protuberances as disclosed in U.S. Pat. No. 5,378,407, it is impossible to obtain a thermistor that has low initial resistance and sufficiently sharp rise in resistance at an operating temperature.

Thus, never until now is an organic positive temperature coefficient thermistor achieved, which can show good performance at an operating temperature of less than 100° C. that is little hazardous to the human body, and have high performance stability.

SUMMARY OF THE INVENTION

A primary object of the present invention is to provide an organic positive temperature coefficient thermistor that can be operated at a temperature of 60 to 70° C. substantially harmless to the human body, has sufficiently low initial resistance in a non-operating state (at room temperature), a sharp resistance rise upon operation, a large rate of resistance change upon transition from its non-operating state to operating state, and stable performance even upon repetitive operations.

Such an object is achieved by the inventions defined below as (1) to (5).

(1) An organic positive temperature coefficient thermistor in which a polyethylene oxide having a weight-average molecular weight of 2,000,000 or higher is blended with conductive particles, each having spiky protuberances thereon.

(2) The organic positive temperature coefficient thermistor of (1), wherein said conductive particles, each having spiky protuberances, are interconnected in a chain form.

(3) The organic positive temperature coefficient thermistor of (1), wherein the weight-average molecular weight of said polyethylene oxide is 3,000,000 to 6,000,000.

(4) The organic positive temperature coefficient thermistor of (2), wherein said chain form of interconnected conductive particles, each having spiky protuberances, have an average particle diameter of at least 0.1 μm.

(5) The organic positive temperature coefficient thermistor of (4), wherein said average particle diameter is 1.0 to 4.0 μm.

The thermistor according to the present invention, because of using a specific polyethylene oxide, can well serve as a protective element that can be operated at a temperature of 60 to 70° C. little hazardous to the human body.

In the present invention, the spiky shape of protuberances on the conductive particles enables a tunnel current to pass readily through the thermistor, and makes it possible to obtain lower initial resistance than would be possible with spherical conductive particles. When the thermistor is in operation, a large resistance value is obtainable because spacings between the conductive particles are larger than those between spherical conductive particles.

It has also been found that performance changes by repetitive operations can be critically reduced by limiting the crystalline polymer to a specific polyethylene oxide having a weight-average molecular weight Mw of 2,000,000 or higher. At this time, the reason for such performance improvement is unclear. A possible explanation is that the dispersion of conductive particles in the crystalline polymer is more homogeneous due to an improvement in the wettability of the crystalline polymer with respect to the conductive particles, so that the crystallographic state of the crystalline polymer and the dispersion state of the mixture can remain substantially unaffected even upon repetitive heating and cooling.

In this regard, it is noted that JP-A 5-47503 discloses "an organic positive temperature coefficient thermistor characterized by comprising a crystalline polymer, and conductive particles milled with said crystalline polymer, each of said conductive particles having spiky protuberances". However, the crystalline polymer exemplified therein is polyvinylidene fluoride. The publication refers to polyethylene oxide as one example of the crystalline polymer, but fails to refer to a specific polyethylene oxide having such a molecular weight as intended in the present invention. Of course, the publication says nothing about one particular advantage of the present invention that performance changes due to repeated operations can be reduced.

BRIEF DESCRIPTION OF THE DRAWINGS

The above and other objects, features, and advantages of the present invention will be better understood from the following description taken in conjunction with the accompanying drawings, in which.

DETAILED DESCRIPTION OF THE INVENTION

Figure 1:
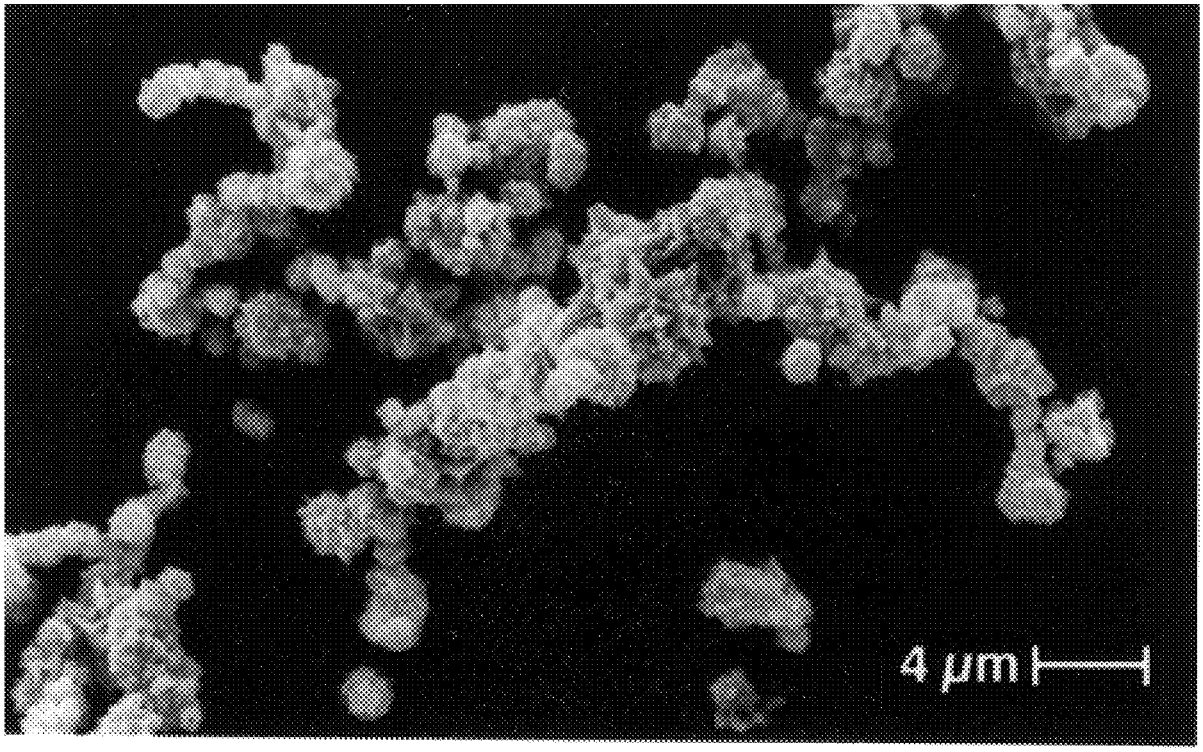
FIG. 1 is a scanning electron microphotograph showing a particulate structure of filamentary nickel powders.

Some preferred embodiments of the present invention will now be explained at great length.

In the organic positive temperature coefficient thermistor according to the present invention, the polyethylene oxide (PEO) used as the crystalline polymer and having a weight-average molecular weight of 2,000,000 or higher is milled with the conductive particles each having spiky protuberances.

This enables the thermistor to be operated at a temperature of about 60 to 70° C.

The weight-average molecular weight Mw of the polyethylene oxide used herein is preferably 2,000,000 or higher, and more preferably 3,000,000 to 6,000,000. Where Mw<2,000,000, the melt viscosity of the polyethylene oxide becomes too low, and so the dispersion state of the conductive particles in the polyethylene oxide becomes worse. Consequently, it is difficult to lower the resistance of the thermistor at room temperature.

The polyethylene oxide with Mw>2,000,000 has a melting point of about 60 to 70° C. and a density of 1.15 to 1.22 g/cm$^3$.

The conductive particles used herein, each having spiky protuberances, are each made up of a primary particle having pointed protuberances. More specifically, a number of (usually 10 to 500) conical and spiky protuberances, each having a height of ⅓ to 1/50 of particle diameter, are present on one single particle. The conductive particles are preferably made up of nickel or the like.

Although such conductive particles may be used in a discrete powder form, it is preferable that they are used in a chain form of about 10 to 1,000 interconnected primary particles. The chain form of interconnected primary particles may partially include primary particles. Examples of the former include a spherical form of nickel powders having spiky protuberances, one of which is commercially available under the trade name of INCO Type 123 Nickel Powder (Inco Co., Ltd.). These powders have an average particle diameter of about 3 to 7 μm, an apparent density of about 1.8 to 2.7 g/cm$^3$, and a specific surface area of about 0.34 to 0.44 m$^2$/g.

Preferred examples of the latter are filamentary nickel powders, some of which are commercially available under the trade names of INCO Type 255 Nickel Powder, INCO Type 270 Nickel Powder, INCO Type 287 Nickel Powder, and INCO Type 210 Nickel Powder, with the former three being preferred. The primary particles have an average particle diameter of preferably at least 0.1 μm, and more preferably from about 0.5 to about 4.0 μm inclusive. Primary particles having an average particle diameter of 1.0 to 4.0 μm inclusive are most preferred, and may be mixed with 50% by weight or less of primary particles having an average particle diameter of 0.1 μm to less than 1.0 μm. The apparent density is about 0.3 to 1.0 g/cm$^3$ and the specific surface area is about 0.4 to 2.5 m$^2$/g. One scanning electron microphotograph of such a chain form of filamentary nickel powders is attached hereto as FIG. 1. In this regard, it is noted that the average particle diameter is measured by the Fischer subsieve method.

In the practice of the present invention, it is preferred that the weight ratio of the polyethylene oxide crystalline polymer to the conductive particles is about 1:3 to 1:5. At such a weight ratio it is possible to take full advantage of the present invention. When the amount of the conductive particles becomes too small, it is difficult to make the initial resistance of the thermistor in its non-operating state sufficiently low. When the amount of the conductive particles becomes too large on the contrary, it is difficult to make the resistance value of the thermistor at its operation temperature large.

In the practice of the present invention, the conductive particles are preferably melt blended with the crystalline polymer at a temperature that is higher than the melting point of the latter (especially melting temperature+10 to 40° C.). When the polyethylene oxide is used in the present invention, melt blending may be carried out at about 80 to 110° C. More specifically, blending is done in known manners using, e.g., a mill for a period of about 5 to 60 minutes.

The obtained mixture is pressed into having a desired thickness. If required, post-pressing treatments such as crosslinking treatment may be carried out.

Thereafter, nickel, copper or other electrodes are attached to the pressed mixture. The electrodes may be connected simultaneously with the above pressing procedure.

The organic positive temperature coefficient thermistor according to the present invention has low initial resistance in its non-operating state and a resistance value of about 0.001 to 0.05 Ω as measured at room temperature, with a sharp resistance rise in operation and a rate of resistance change upon transition from its non-operating state to operating state being about 9 or 10 orders of magnitude. Deterioration of performance by repetitive operations is also much more reduced.

The present invention will now be explained more specifically with reference to examples, and comparative examples.

EXAMPLE 1

Polyethylene oxide I where Mw=4,300,000 to 4,800,000 and mp=67° C. was used as the crystalline polymer, and filamentary nickel powders (INCO Type 255 Nickel Powder made by Inco Co., Ltd.) in such a chain form as shown in FIG. 1 were used as the conductive particles. The conductive particles used had an average particle diameter of 2.2 to 2.8 μm, an apparent density of 0.5 to 0.65 g/cm$^3$, and a specific surface area of 0.68 m$^2$/g.

Added to the polyethylene oxide were a chain form of filamentary nickel powders in a weight of four times as large for a 15-minute blending in a mill at 80° C.

Figure 2:
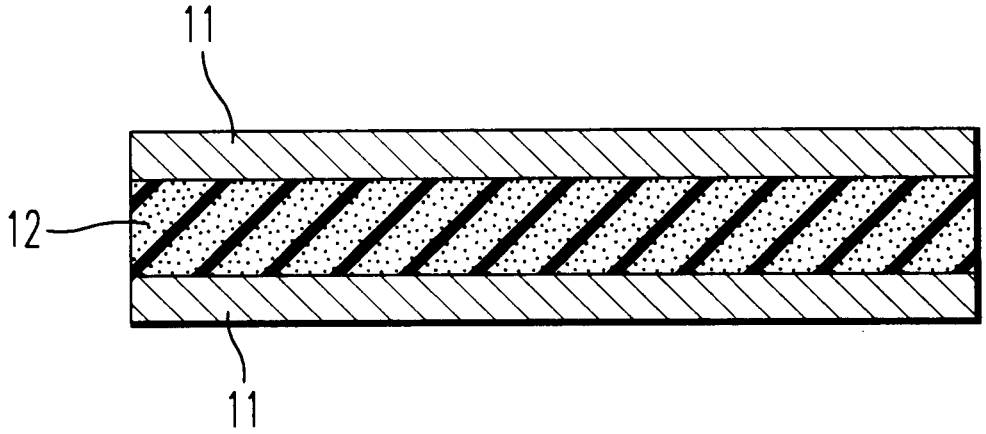
FIG. 2 is a sectional schematic of an organic positive temperature coefficient thermistor sample.

Nickel foils of 30 μm in thickness were placed on and pressed against both sides of the resulting mixture for pressing. In this way, a pressed assembly of 1 mm in total thickness was obtained. This assembly was then punched out into a disk shape of 10 mm in diameter, thereby obtaining a thermistor sample having such a sectional shape as shown in FIG. 2. As can be seen from FIG. 2, the sample is made up of a pressed sheet 12 comprising the crystalline polymer and conductive particles, and a pressed sheet 12 is sandwiched between nickel foil electrodes 11.

Figure 3:
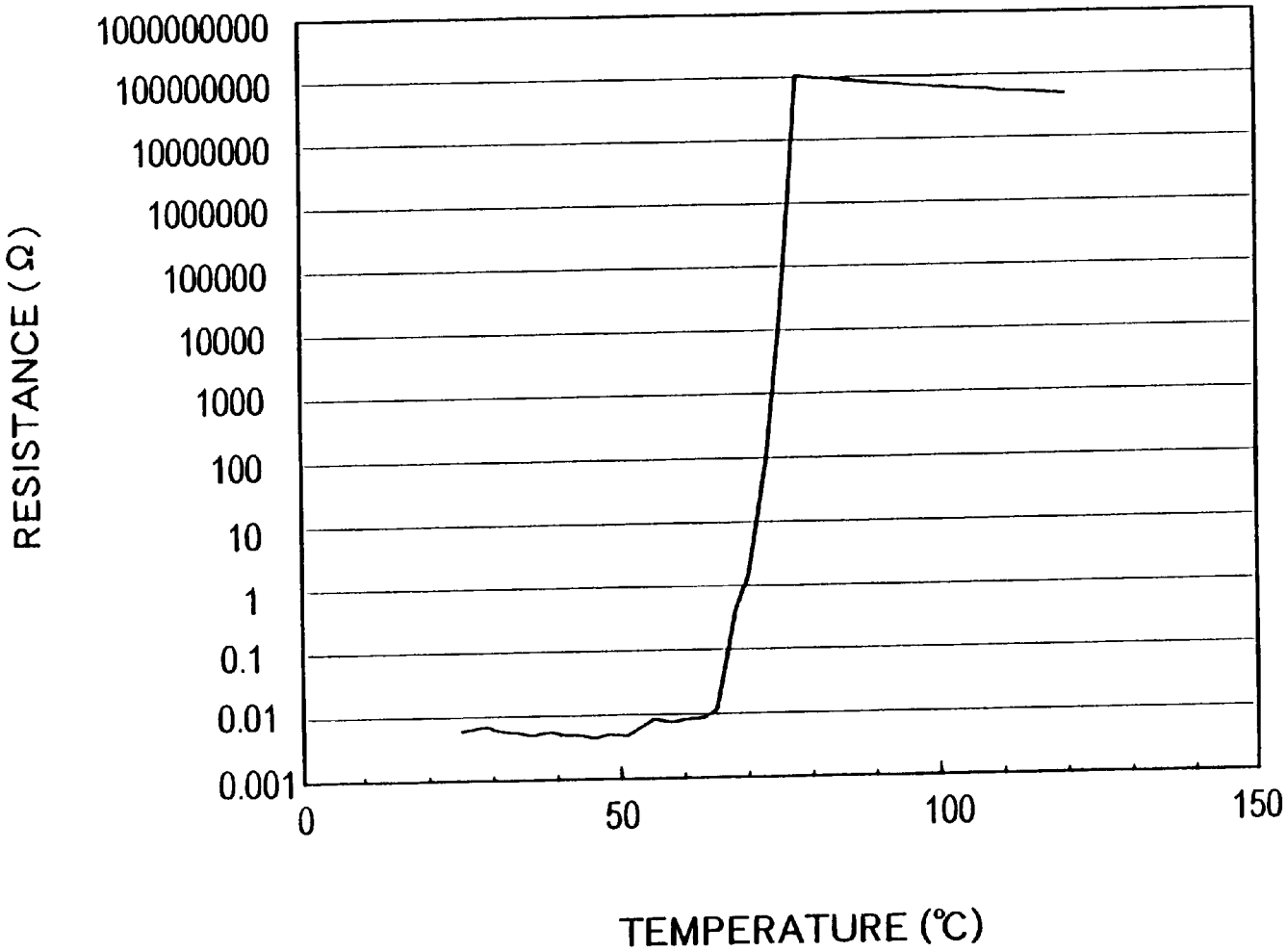
FIG. 3 is a temperature vs. resistance curve for the sample of Example 1.

This sample was heated and cooled in a thermostatic oven to measure its resistance value at predetermined temperatures, thereby obtaining a temperature vs. resistance curve as shown in FIG. 3.

From FIG. 3, it can be seen that the sample has an initial room temperature resistance value of 0.006 Ω at room temperature (25° C.), and shows a sharp resistance rise upon heating at its transition temperature (65° C.) or higher and reaches a maximum resistance value of $6\times10^7$ Ω, with a rate of resistance change of 10.0 orders of magnitude. An index to the sharpness or degree of resistance rise in the vicinity of the transition temperature was found as mentioned below.

Degree of Resistance Rise

Figure 4:
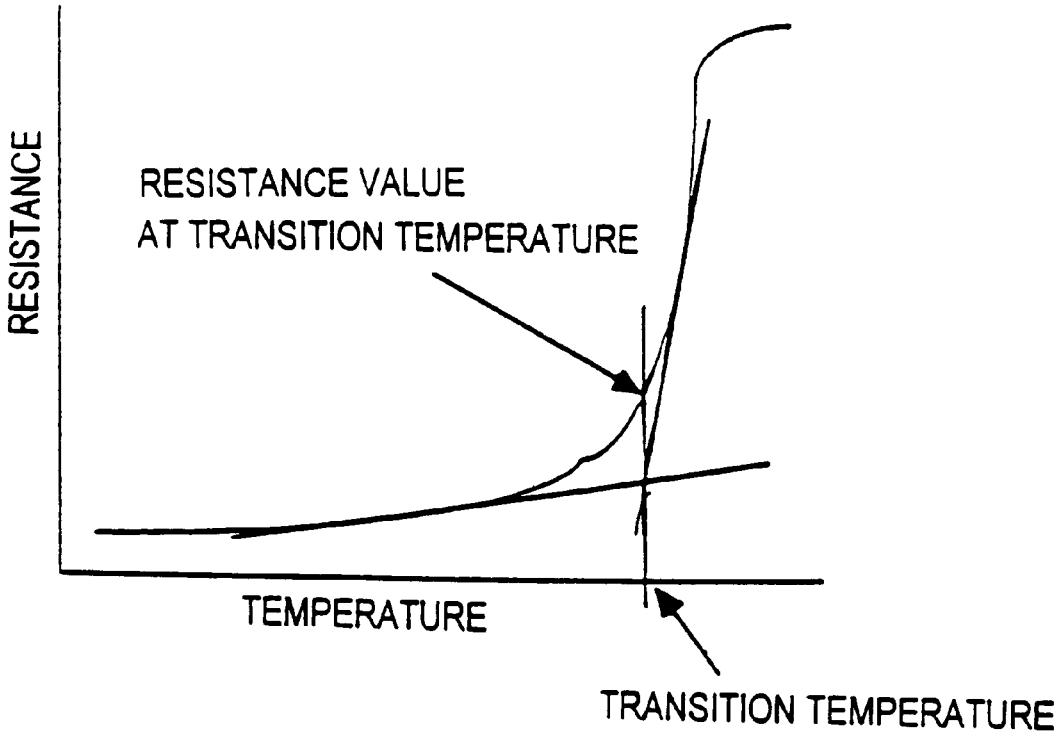
FIG. 4 is a schematic representation of how to determine transition temperature and resistance value at the transition temperature for the purpose of finding the degree of resistance rise from a temperature vs. resistance curve.

On the temperature vs. resistance curve shown in FIG. 4, the transition temperature of a sample is first found from a point of intersection between a tangent line at a point on a curve segment before transition and a tangent line at a point on a curve segment after transition. It is noted that all the transition temperatures referred to throughout the disclosure were obtained as mentioned just above. Then, the rate (order) of resistance change A between a resistance value found at the transition temperature and a resistance value at room temperature is determined to find an A/B ratio (%) where B is the rate (order) of resistance change of the sample as already stated. It is to be understood that the smaller the A/B ratio, the sharper is the resistance rise.

Figure 5:
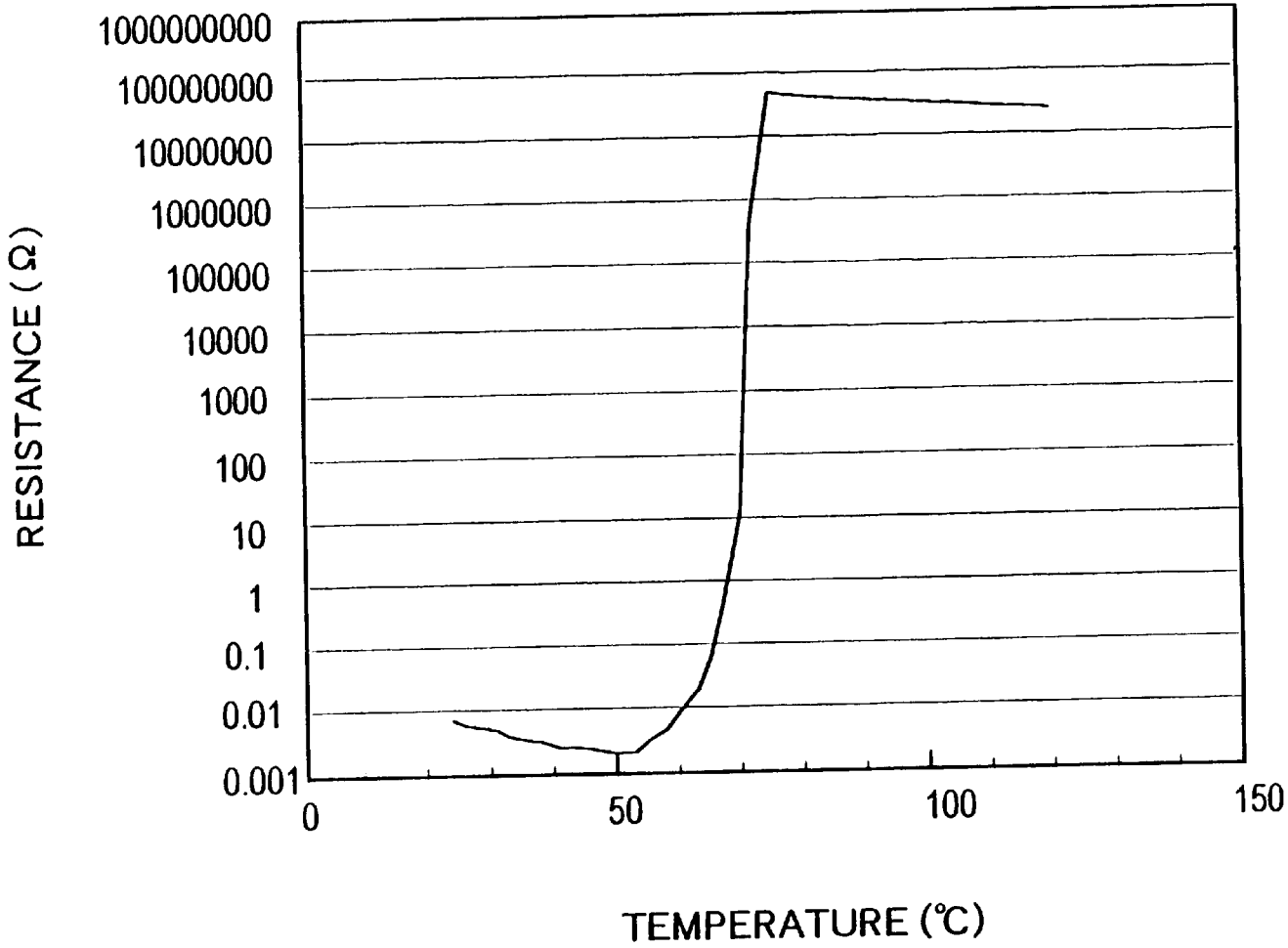
FIG. 5 is a temperature vs. resistance curve for the sample of Example 1 as found after 10 heating/cooling test cycles.

Next, the sample was subjected to ten heating/cooling test cycles, each involving heating the sample at a heating rate of 2° C. per minute from room temperature to 120° C., and cooling the sample at a cooling rate of 2° C. per minute from 120° C. down to room temperature. Following this, a temperature vs. resistance was obtained as mentioned above to find the room temperature resistance value, maximum resistance value, rate of resistance change, and degree of resistance rise. A temperature vs. resistance curve after the ten heating/cooling test cycles, as shown in FIG. 5, was almost the same as the initial temperature vs. resistance curve (FIG. 3).

These results are collectively set out in Table 1. It is noted that the degree of resistance rise after the ten heating/cooling test cycles remained substantially unchanged. The characteristic values used to calculate the degree of resistance rise are shown in Table 2.

EXAMPLE 2

A thermistor sample was obtained following Example 1 except that a chain form of filamentary nickel powders II (INCO Type 287 Nickel Powder made by Inco Co., Ltd. and having an average particle diameter of 2.6 to 3.3 μm, an apparent density of 0.75 to 0.95 g/cm$^3$, and a specific surface area of 0.58 m$^2$/g) were used as the conductive particles. This sample was then used to obtain such a temperature vs. resistance curve as shown in FIG. 6.

Figure 6:
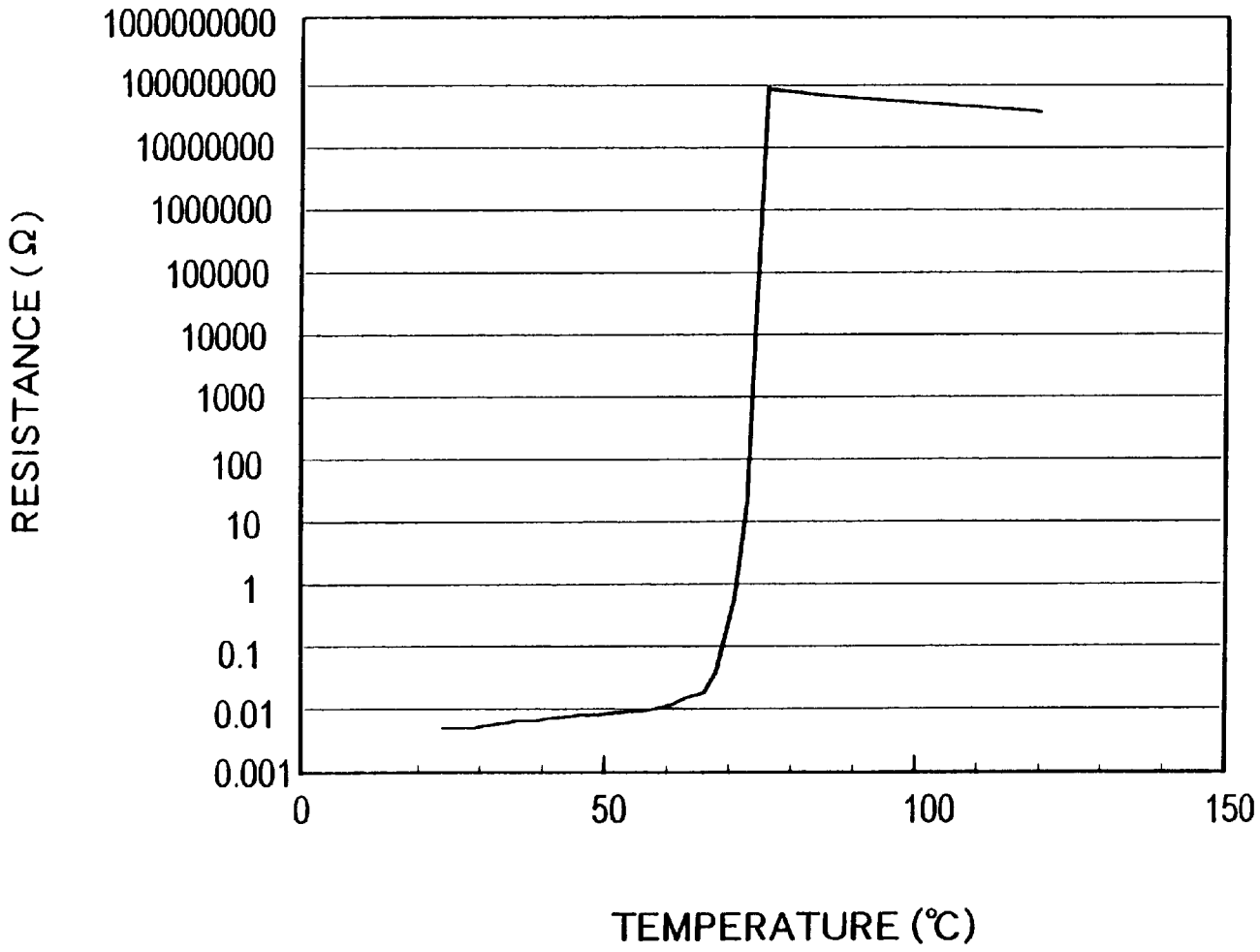
FIG. 6 is a temperature vs. resistance curve for the sample of Example 2.

From FIG. 6, it can be seen that there is a sharp resistance rise at a temperature greater than the transition temperature (65° C.). Characteristic values inclusive of transition temperature were found as in Example 1. In addition, characteristic values were found after the completion of ten heating/cooling cycles under similar conditions as in Example 1. It is noted that a temperature vs. resistance curve after the completion of the ten heating/cooling cycles was much the same as the initial temperature vs. resistance curve (FIG. 6).

These results are collectively set out in Table 1.

EXAMPLE 3

Figure 7:
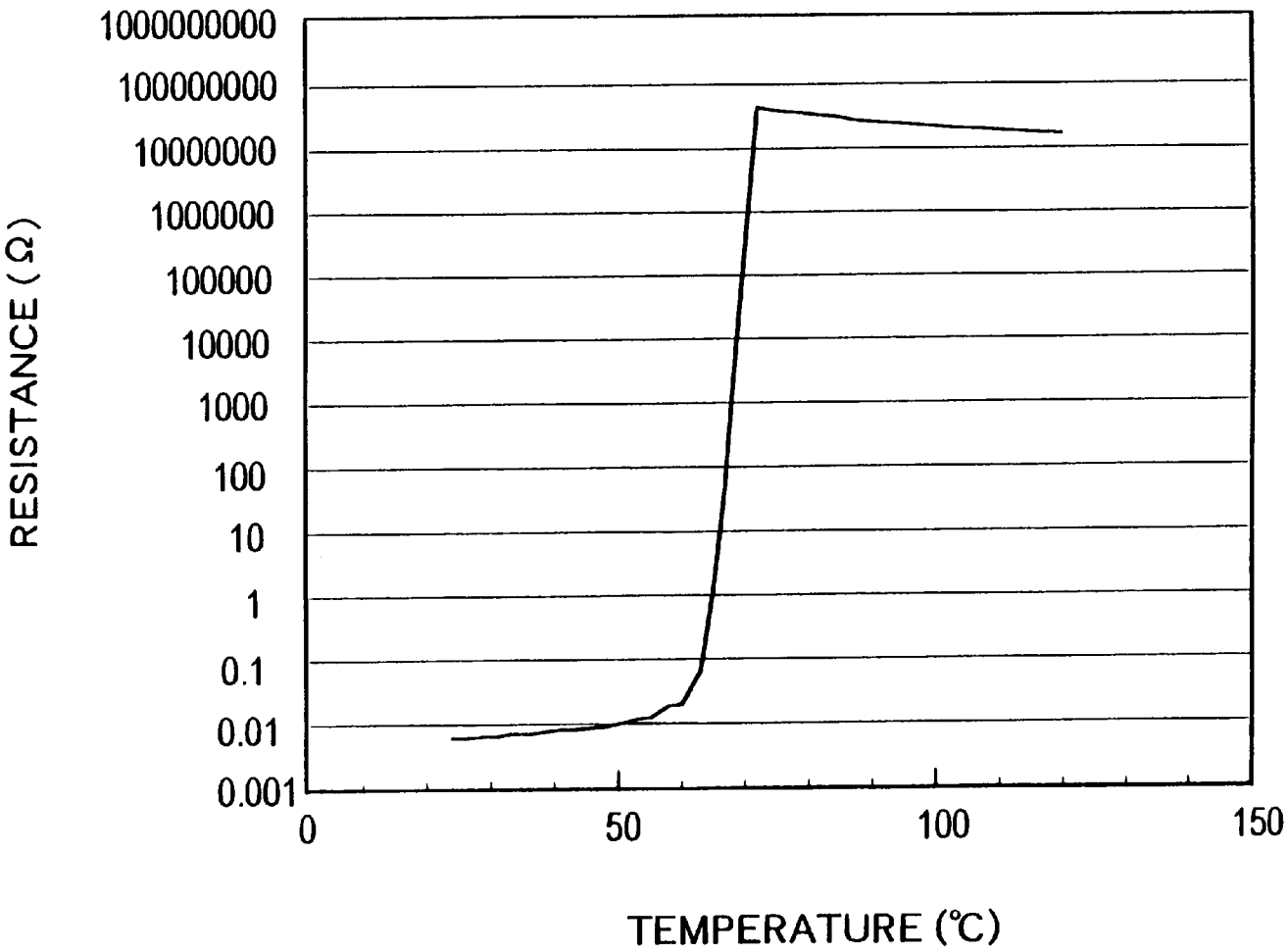
FIG. 7 is a temperature vs. resistance curve for the sample of Example 3.

A thermistor sample was obtained following Example 1 except that polyethylene oxide II where Mw=3,300,000 to 3,800,000 and mp=67° C. was used as the crystalline polymer. This sample was used to obtain a temperature vs. resistance curve. The results are plotted in FIG. 7.

Comparative Example 1

A thermistor sample was obtained following Example 1 with the exception that polyvinylidene fluoride where mp=175° C. and Mw=300,000 was used as the crystalline polymer and the milling temperature was changed to 195° C. This sample was used to obtain such a temperature vs. resistance curve. The results are plotted in FIG. 8.

Figure 8:
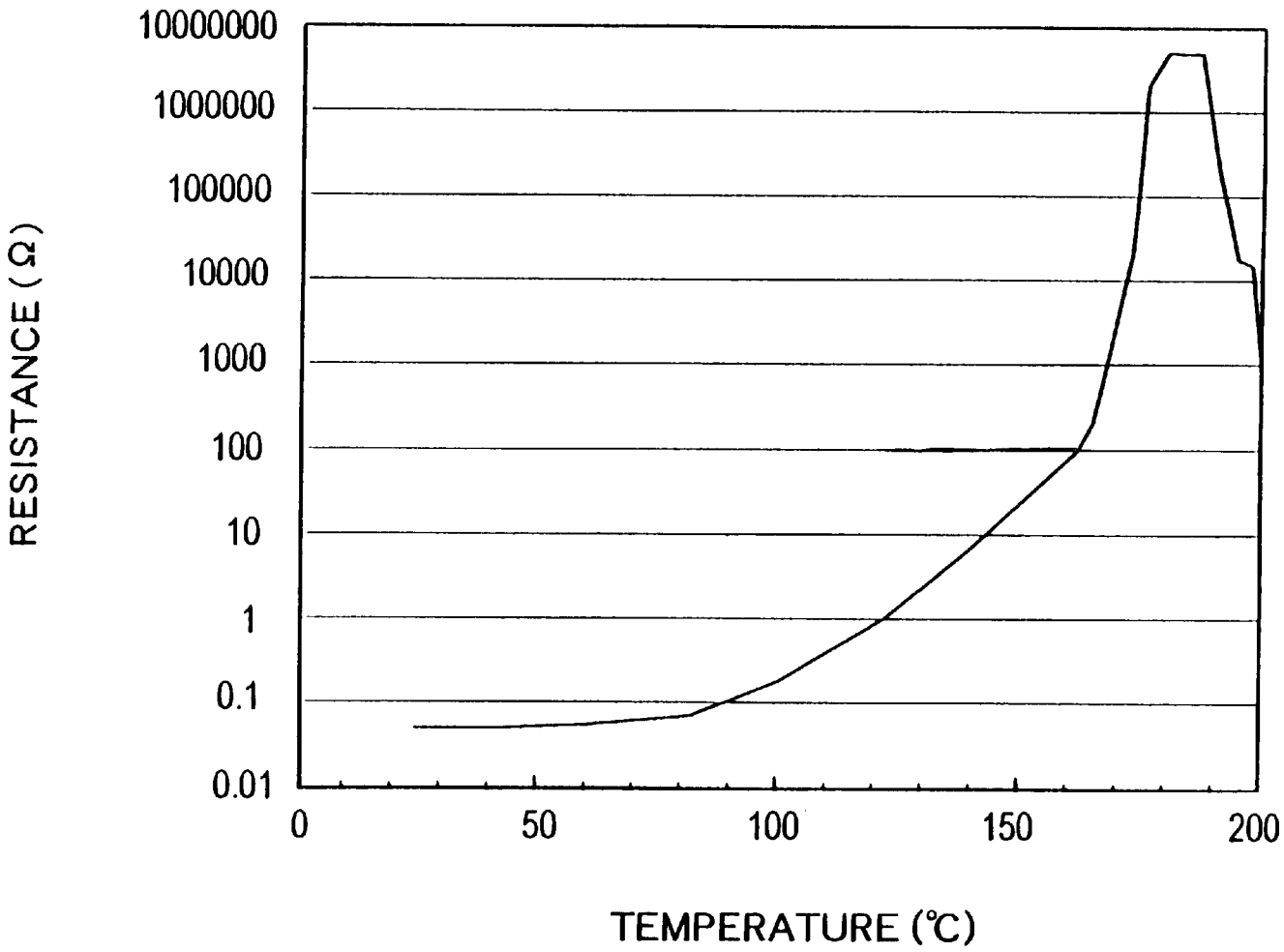
FIG. 8 is a temperature vs. resistance curve for the sample of Comparative Example 1.

From FIG. 8, it can be seen that there is a sharp resistance rise at greater than the transition temperature (159° C.). Characteristic values were found as in Example 1. In addition, ten heating/cooling test cycles were carried out under similar conditions as in Example 2, provided however that the sample was heated to and cooled from 200° C., thereby finding characteristic values. It is noted that unlike the samples of Examples 1 and 2, a temperature vs. resistance curve after the completion of the ten heating/cooling cycles was largely different from the initial temperature vs. resistance curve (FIG. 8).

These results are collectively set out in Tables 1 and 2.

Comparative Example 2

Figure 9:
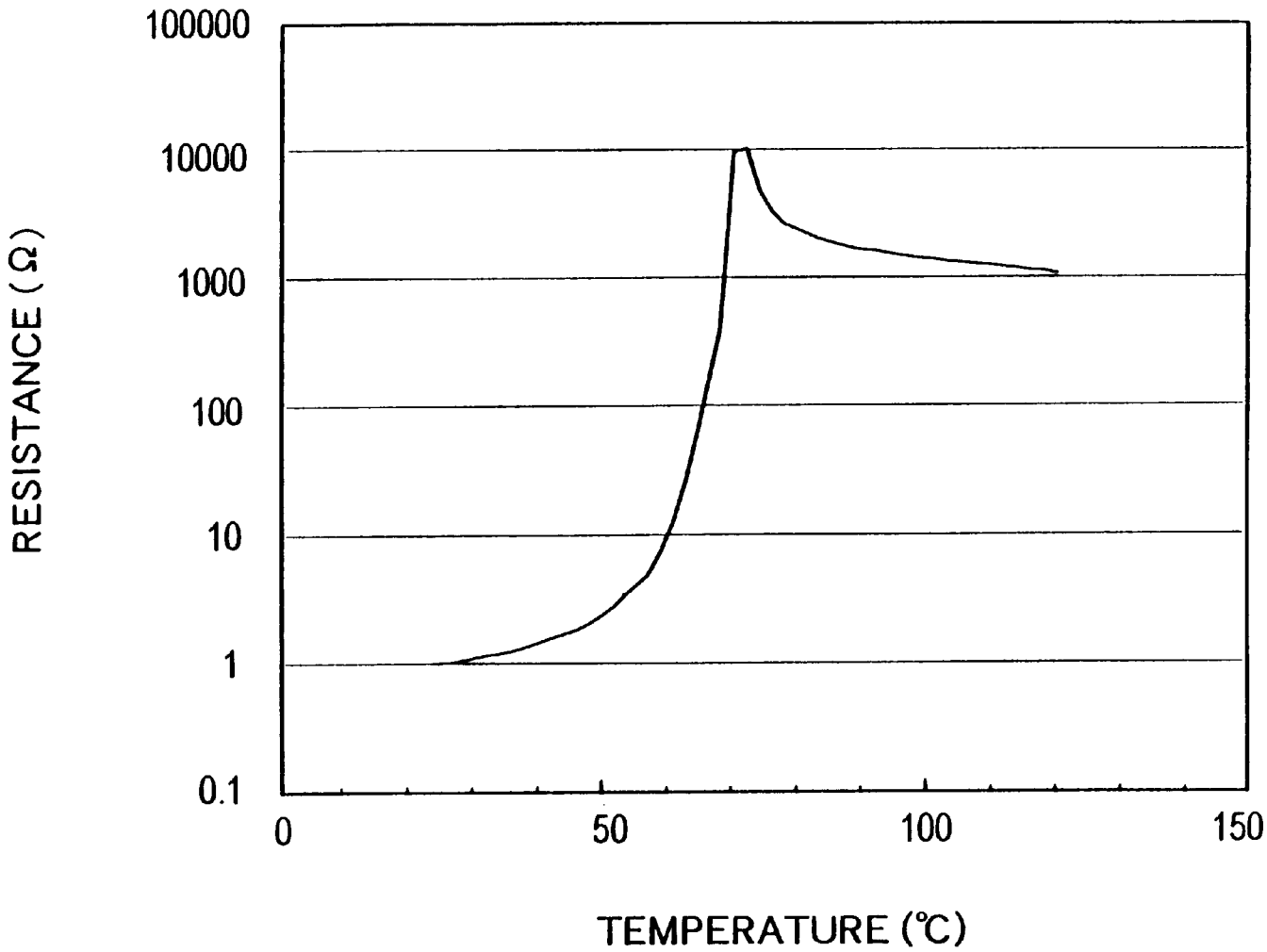
FIG. 9 is a temperature vs. resistance curve for the sample of Comparative Example 2.

A thermistor sample was obtained following Example 1 with the exception that carbon black having an average particle diameter of 40 nm and a specific surface area of 58 $m^2/g$ was used as the conductive particles and equal amounts or weights of polyethylene oxide and carbon black were used. This sample was used to obtain such a temperature vs. resistance curve as shown in FIG. 9. Initial (before heating/cooling cycles) characteristic values, and post-heating/cooling cycle characteristic values were found as in Example 1, provided however that the number of heating/cooling test cycles was only three. The results are shown in Tables 1 and 2.

Comparative Example 3

Figure 10:
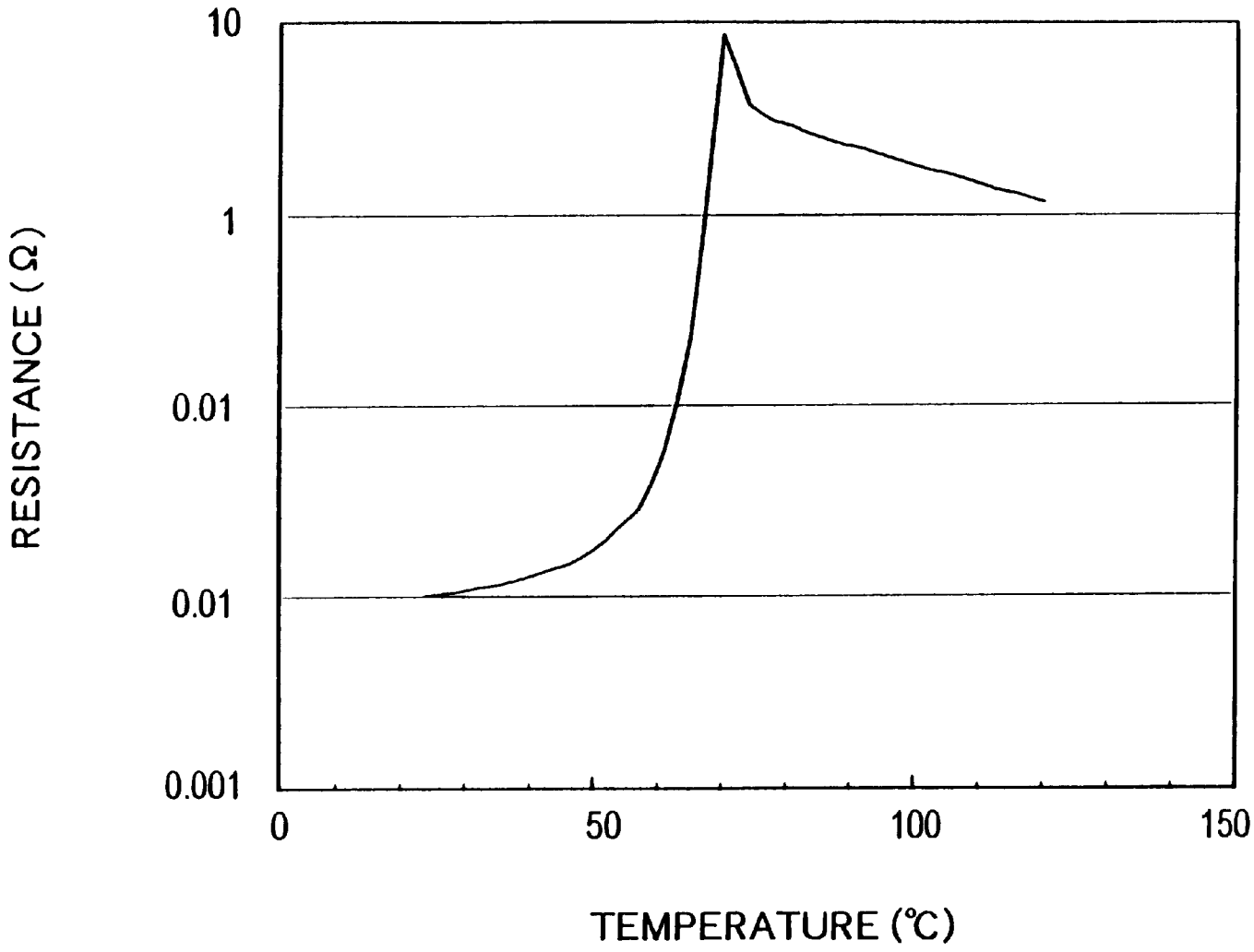
FIG. 10 is a temperature vs. resistance curve for the sample of Comparative Example 3.

A thermistor sample was obtained following Example 1 with the exception that spherical nickel powders (INCO Type 110 Nickel Powder made by Inco Co., Ltd. and having an average particle size of 0.8 to 1.5 $\mu$m, an apparent density of 0.9 to 1.5 $g/cm^3$ and a specific surface area of 0.9 to 2 $m^2/g$) were used as the conductive particles. This sample was used to obtain such a temperature vs. resistance curve as shown in FIG. 10. Initial (before heating/cooling cycles) characteristic values, and post-heating/cooling cycle characteristic values were found as in Example 1. The results are shown in Tables 1 and 2.

Comparative Example 4

Figure 11:
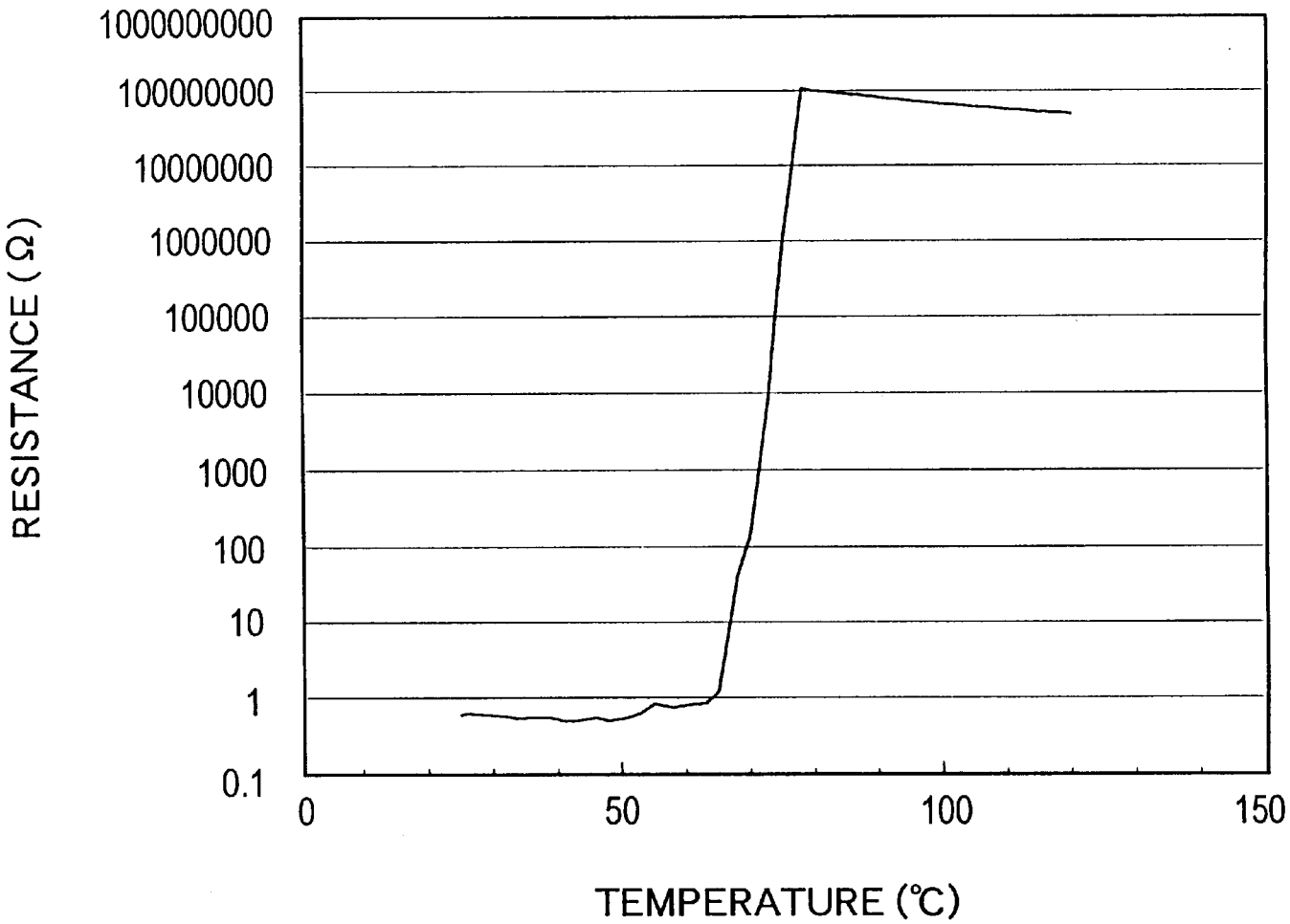
FIG. 11 is a temperature vs. resistance curve for the sample of Comparative Example 4.

A thermistor sample was obtained following Example 1 with the exception that polyethylene oxide where Mw=600,000 to 1,100,000 was used as the crystalline polymer. This sample was used to obtain such a temperature vs. resistance curve as shown in FIG. 11. Initial (before heating/cooling cycles) characteristic values, and post-heating/cooling cycle characteristic values were found as in Example 1. The results are shown in Tables 1 and 2.

Comparative Example 5

A sample was obtained following Example 1 with the exception that an ethylene-vinyl acetate copolymer (Novatech EVALV 241 made by Nippon Polychem Co., Ltd. and having a vinyl acetate content of 8% by weight) was used as the crystalline polymer. This sample was used to find characteristic values as in Example 1. The sample was consequently found to have a transition temperature of 61° C. and a room temperature resistance value of 0.29 Ω, with the degree of resistance rise, A/B, being larger than those of Examples 1–3. A similar cycle test as in Example 1 was performed. At the second heating/cooling cycle, however, the room temperature resistance value increased markedly and so reached 1,250 Ωn.

Comparative Example 6

A sample was obtained following Example 1 with the exception that an ethylene-methacrylic acid copolymer (Nucrel N1525 made by Mitsui·Du Pont Polychemical Co., Ltd. and having a methacryic acid content of 15% by weight) was used as the crystalline polymer. This sample was used to find characteristic values as in Example 1. The sample was consequently found to have a transition temperature of 65° C. and a room temperature resistance value of 0.008 Ω with the degree of resistance rise, A/B, being larger than those of Examples 1–3. A similar cycle test as in Example 1 was performed. At the second heating/cooling cycle, however, the room temperature resistance value increased markedly and so reached 0.04 Ω.

Comparative Example 7

A sample was obtained following Example 1 with the exception that an ethylene-ethyl acrylate copolymer (having an ethyl acrylate content of 6.6% by weight and made by Union Carbide Corp.) was used as the crystalline polymer. Characteristic values were found as in Example 1. In addition, characteristic values were found after ten heating/cooling test cycles performed according to Example 1. In Comparative Example 7, too, there was a marked increase in room temperature resistance, as in the case of Comparative Examples 5 and 6.

TABLE 1

| | | | TT | RTRV (Ω) | | MRV (Ω) | | RORC (order) | | DORR |
|---|---|---|---|---|---|---|---|---|---|---|
| Sample | Polymer | CP | (° C.) | I | Phcc | I | Phcc | I | Phcc | Initial A/B (%) |
| Ex. 1 | PEO I (Mw 4.3–4.8 × $10^6$) | F—Ni I | 65 | 0.006 | 0.009 | $6 \times 10^7$ | $9 \times 10^7$ | 10.0 | 10.0 | 5.2 |
| Ex. 2 | PEO I (Mw 4.3–4.8 × $10^6$) | F—Ni II | 69 | 0.005 | 0.006 | $1 \times 10^8$ | $1 \times 10^8$ | 10.3 | 10.2 | 10.5 |
| Ex. 3 | PEO II (Mw 3.3–3.8 × $10^6$) | F—Ni I | 62 | 0.006 | 0.009 | $4 \times 10^7$ | $6 \times 10^7$ | 9.8 | 9.8 | 9.4 |

TABLE 1-continued

| Sample | Polymer | CP | TT (° C.) | RTRV (Ω) I | RTRV (Ω) Phcc | MRV (Ω) I | MRV (Ω) Phcc | RORC (order) I | RORC (order) Phcc | DORR Initial A/B (%) |
|---|---|---|---|---|---|---|---|---|---|---|
| Comp. 1 | PVF (Mw $3 \times 10^5$) | F—Ni I | 159 | 0.05 | 15 | $5 \times 10^6$ | $4.7 \times 10^8$ | 8.0 | 7.5 | 40.1 |
| Comp. 2 | PEO I (Mw $4.3–4.8 \times 10^6$) | CB | 61 | 1 | 35 | $1 \times 10^4$ | $1.1 \times 10^6$ | 4.0 | 4.5 | 27.8 |
| Comp. 3 | PEO I (Mw $4.3–4.8 \times 10^6$) | S—Ni | 61 | 0.01 | 0.08 | 10 | $1.3 \times 10^2$ | 3.0 | 3.2 | 25.9 |
| Comp. 4 | PEO III (Mw $0.6–1.1 \times 10^6$) | F—Ni I | 65 | 0.6 | 0.8 | $6 \times 10^7$ | $7 \times 10^7$ | 8.0 | 7.9 | 3.8 |

CP: Conductive particles
TT: Transition temperature
RTRV: Room temperature resistance value
I: Initial resistance value at room temperature
Phcc: Post-heating/cooling cycle resistance value at room temperature
F—Ni: Filamentary nickel
S—Ni: Spherical nickel
CB: Carbon black
MRV: Maximum resistance value
RORC: Rate of resistance change
DORR: Degree of resistance rise

TABLE 2

| Sample | RTR (Ω) | TT (° C.) | TTR (Ω) | RRCTTRT A (order) | RORC B (order) | A/B (%) |
|---|---|---|---|---|---|---|
| Ex. 1 | 0.006 | 65 | 0.02 | 0.5 | 10.0 | 5.2 |
| 2 | 0.005 | 69 | 0.06 | 1.1 | 10.3 | 10.5 |
| 3 | 0.006 | 62 | 0.05 | 0.9 | 9.8 | 9.4 |
| Comp. 1 | 0.05 | 159 | 80 | 3.2 | 8.0 | 40.1 |
| 2 | 1 | 61 | 13 | 1.1 | 4.0 | 27.8 |
| 3 | 0.01 | 61 | 0.06 | 0.8 | 3.0 | 25.9 |
| 4 | 0.6 | 65 | 1.2 | 0.3 | 8.0 | 3.8 |

RTR: Room temperature resistance
TTR: Resistance at transition temperature
RRCTTRT: Rate of resistance change between transition temperature and room temperature From the results set out in Tables 1 and 2, and shown in FIGS. 3 and 5–11, it is understood that the samples according to Examples 1–3 have an operating temperature of 60 to 70° C. and sufficiently low room temperature resistance, and exhibit a sharp resistance rise upon heating to a temperature greater than their transition temperature, with a large maximum resistance value, a large rate of resistance change, and little or no deterioration of performance by repetitive heating and cooling. These samples are particularly suitable for overheat-preventing elements for secondary batteries because of their low transition temperature and sufficiently low room temperature resistance.

In contrast, the sample of Comparative Example 1 using vinylidene fluoride as the crystalline polymer is found to exhibit a noticeable increase in room temperature resistance by repetitive heating and cooling and a decreased degree of resistance rise. The sample of Comparative Example 2 using carbon black is found to have large initial resistance at room temperature and a decreased rate of resistance change, and exhibit a noticeable increase in room temperature resistance by repetitive heating and cooling, with a decreased degree of resistance rise. The sample of Comparative Example 3 using spherical nickel is found to have a decreased rate of resistance change with a decrease in the degree of resistance rise. In the sample of Comparative Example 4 using polyethylene oxide where Mw<2,000,000, the dispersibility of the conductive particles becomes worse because its melt viscosity is too low, resulting in high room temperature resistance.

The samples of Comparative Example 5 using the ethylene-vinyl acetate copolymer, Comparative Example 6 using the ethylene-methacrylic acid copolymer and Comparative Example 7 using the ethylene-ethyl acrylate copolymer suffer considerable deterioration of performance by repetitive heating and cooling.

EXAMPLE 4

Run on the sample of Example 1 was a load test involving the repetition of a cycle where d.c. 10 A and 2 V were applied on the sample according to Example 1 to operate it by Joule heat for a period of 10 seconds, and the same current and voltage were again applied on the sample after disconnecting the sample from the power supply for 10 seconds. A temperature vs. resistance curve was measured every a given number of load cycles.

It was consequently found that the sample had an initial room temperature resistance value of 0.006 Ω, a maximum resistance value of $6 \times 10^7$ Ω and a rate of resistance change of 10.0 orders of magnitude before subject to the load test, and had a room temperature resistance value of 0.008 Ω, a maximum resistance value of $2.5 \times 10^7$ Ω and a rate of resistance change of 9.5 orders of magnitude even after 1,000 load cycles; there was only a slight performance change between before and after the load test. The sample was found to have a degree of initial resistance rise of 5.2% as in Example 1, before subject to the load test, and exhibited a sharp resistance rise even after subject to the load test.

Comparative Example 8

Run on the sample of Comparative Example 1 using polyvinylidene fluoride was the same load test as in Example 4.

It was consequently found that the sample had an initial room temperature resistance value of 0.05 Ω, a maximum resistance value of $5 \times 10^6$ Ω and a rate of resistance change of 8.0 orders of magnitude before subjected to the load test, and had a room temperature resistance value of 8 Ω, a maximum resistance value of $2.5 \times 10^8$ Ω and a rate of resistance change of 7.5 orders of magnitude after 1,000 load cycles; that is, a striking increase in a room temperature resistance was observed after the load test. The degree of initial resistance rise of the sample before subjected to the load test was 40.1% as in Comparative Example 1, and made no marked difference with that after subjected to the load test. However, this sample was much poorer in the sharpness of resistance rise.

The present invention can successfully provide an organic positive temperature coefficient thermistor which is operated at a temperature of 60 to 70° C. little harmful to the human body, and has low initial resistance value at room temperature, a large rate of resistance change, a sharp resistance rise at a temperature higher than the transition temperature, and stable performance upon repeated operations.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential purport thereof. Therefore, it is intended that the invention not be limited to the particular embodiment disclosed as the best mode contemplated for carrying out this invention, but that the invention will include all embodiments failing within the scope of the appended claims.

What is claimed is:

1. An organic positive temperature coefficient thermistor, comprising a polyethylene oxide having a weight-average molecular weight of 2,000,000 or higher and conductive particles having spiky protuberances thereon.

2. The organic positive temperature coefficient thermistor of claim 1, wherein said conductive particles, having spiky protuberances, are interconnected in a chain form.

3. The organic positive temperature coefficient thermistor of claim 1, wherein the weight-average molecular weight of said polyethylene oxide is 3,000,000 to 6,000,000.

4. The organic positive temperature coefficient thermistor of claim 2, wherein said chain form of interconnected conductive particles, each having spiky protuberances, have an average particle diameter of at least 0.1 $\mu$m.

5. The organic positive temperature coefficient thermistor of claim 4, wherein said average particle diameter is 1.0 to 4.0 $\mu$m.

6. The organic positive temperature coefficient thermistor of claim 1, which operates at a temperature of about 60 to 70° C.

7. The organic positive temperature coefficient thermistor of claim 1, wherein said polyethylene oxide has a melting point of about 60 to 70° C. and a density of 1.15 to 1.22 g/cm$^3$.

8. The organic positive temperature coefficient thermistor of claim 1, wherein said conductive particles have about 10 to 500 conical and spiky protuberances for each single particle.

9. The organic positive temperature coefficient thermistor of claim 1, wherein said spiky protuberances on said conductive particles have a height of ⅓ to 1/50 of particle diameter.

10. The organic positive temperature coefficient thermistor of claim 1, wherein said conductive particles are in a chain form of about 10 to 1,000 interconnected primary particles.

11. The organic positive temperature coefficient thermistor of claim 1, wherein said conductive particles are a nickel powder.

12. The organic positive temperature coefficient thermistor of claim 11, wherein said nickel powder is a spherical powder.

13. The organic positive temperature coefficient thermistor of claim 12, wherein said nickel powder has an average particle diameter of about 3 to 7 $\mu$m, an apparent density of about 1.8 to 2.7 g/cm$^3$, and a specific surface area of about 0.34 to 0.44 m$^2$/g.

14. The organic positive temperature coefficient thermistor of claim 11, wherein said nickel powder is a filamentary powder.

15. The organic positive temperature coefficient thermistor of claim 14, wherein said nickel powder has an average particle diameter of at least 0.1 $\mu$m, with an apparent density of about 0.3 to 1.0 g/cm$^3$, and a specific surface area of about 0.4 to 2.5 m$^2$/g.

16. The organic positive temperature coefficient thermistor of claim 15, wherein said nickel powder has an average particle diameter of 1.0 to 4.0 $\mu$m inclusive.

* * * * *